United States Patent [19]

Wünning

[11] Patent Number: 4,591,132

[45] Date of Patent: May 27, 1986

[54] APPARATUS FOR CONTROLLING THE GAS CARBURIZATION OF STEEL

[76] Inventor: Joachim Wünning, Berghalde 20, 7250 Leonberg 7, Fed. Rep. of Germany

[21] Appl. No.: 714,802

[22] Filed: Mar. 22, 1985

[30] Foreign Application Priority Data

Mar. 29, 1984 [DE] Fed. Rep. of Germany ..... 3411605

[51] Int. Cl.[4] ..... C21D 11/00

[52] U.S. Cl. ..... 266/80; 266/81; 266/87; 266/90

[58] Field of Search ..... 266/78, 80, 81, 83, 266/85, 87, 88, 90

[56] References Cited

U.S. PATENT DOCUMENTS

| | | | |
|---|---|---|---|
| 2,980,415 | 4/1961 | Beard | 260/81 |
| 4,035,203 | 7/1977 | Hermite et al. | 148/16.5 |
| 4,049,473 | 9/1977 | Davis et al. | 148/16.5 |

FOREIGN PATENT DOCUMENTS

| | | | |
|---|---|---|---|
| 3139622 | 12/1983 | Fed. Rep. of Germany . | |
| 985144 | 1/1983 | U.S.S.R. | 266/81 |

OTHER PUBLICATIONS

Article, Stahl und Eisen 80 (1960, No. 26, pp. 1952–1954).

Article, Zeitschrift fur Wirtschaftliche Fertigung, No. 9, Sep. 1968, pp. 456–464.

*Primary Examiner*—Christopher W. Brody

*Attorney, Agent, or Firm*—Burns, Doane, Swecker & Mathis

[57] ABSTRACT

In the gas carburization of steel, a steel part is exposed in a carbon-enriched atmosphere of a furnace to a diffusion process to form a boundary layer with an increased carbon content, determined as a function of the distance from the surface. The values of importance for the diffusion process are determined intermittently and used as control parameters to affect the diffusion process. The flow of carbon diffusing directly through the surface of the steel part serves as the measured value. The supply of the carburizing gas is controlled as a function of this value.

2 Claims, 6 Drawing Figures

APPARATUS FOR CONTROLLING THE GAS CARBURIZATION OF STEEL

BACKGROUND AND OBJECTS OF THE INVENTION

The invention relates to a process and apparatus for the gas carburizing of steel, wherein the steel part is exposed within a carbon-enriched gas atmosphere of a furnace or the like. The invention also relates to a diffusion process for the formation of a case with an increased carbon content determined as a function of the distance from the surface and wherein in certain time intervals the values important for the diffusion process, including temperature, are determined and used as control parameters to effect the diffusion process.

Gas carburizing processes, such as those used for the case hardening of steel parts, are known, for example in "Zeitschrift fur wirtschaftliche Fertigung", No. 9, September, 1968, pages 456 to 464. During the carburization of a steel workpiece, its surface layer is enriched in carbon. The objective is to obtain a certain gradient of the carbon contained by the completion of the process, with the target values of "depth of carburization", "case carbon content" and "variation of C in the case". This process may be calculated on the basis of the laws of diffusion, as in addition to the temperature and time, certain so-called boundary conditions enter the process as variables, whereby the availability of carbon on the surface is defined.

While in the early days of the technology of case hardening it was assumed that the C content of the surface remains approximately constant during the entire process and that, therefore, the depth of carburization is growing with the square root of time, a demand for increasing accuracy dictated that the process parameters of "carbon potential" and "reaction rate" at the surface be introduced. Depending on the values being measured, the mathematical relationships and the other process values, the variation of C may thus be precalculated, with the carburization of the boundary layer being based on the control of the C potential of the gas atmospehre in the furnace chamber, so that the desired target values may be obtained. It is further known by German DE-P No. 31 39 622 to vary the C potential during carburization with the aid of a computer unit in order to prevent the formation of carbides at the surface of the workpiece in the shortest possible time.

This manner of controlling carburization processes is feasible, however, only if so-called equilibrium atmospheres are present, as only then is the C potential defined and measurable. Atmospheres supersaturated with hydrocarbons have usually been heretofore avoided in view of their limited controllability, even though they could provide an even greater availability of carbon, leading to savings in raw material and energy.

It is, therefore, an object of the present invention to develop a process of the afore-mentioned type, whereby also atmospheres supersaturated with hydrocarbons may be used in carburizing processes, in a manner such that it is possible to unambiguously control and determine the variation of carbon in the boundary layer of the workpiece.

SUMMARY OF THE INVENTION

To attain this and other objects, it is proposed according to the present invention in a process of the aforementioned type to utilize the flow of C directly diffusing through the surface of the steel workpiece as the measured value and to control the supply of the carburizing gas as a function of this value. Such a method is feasible, even though the theoretically known relationships valid for the flow of carbon at the surface of the workpiece cannot be applied directly in actual practice, as this flow of C must be varied in a complex manner, in contrast to the C potential, during the carburizing process, if at the completion of the process a certain carbon gradient is to be obtained. It is feasible, however, to determine this flow continuously or over certain short time intervals by computer as in the known processes, so that the desired control becomes possible, if values of the flow of C are available.

The latter may be accomplished in a simple manner by measuring the flow of C directly by means of the variation in time of the electric resistance of an iron sensor.

In order to eliminate the risk of the running away of the carbon content of the sensor from the carbon content at the surface of the workpiece to be carburized, it is advantageous to adjust the mean carbon content of the iron sensor, by means of intermittent short decarburization phases, to the value of the boundary carbon content of the workpiece, determined by calculation in a known manner. If then, the value determined by the C sensor attains a predetermined value of the boundary carbon content of the workpiece, the supply of the carburizing gas must be reduced, so that, for example, the formation of harmful carbides is prevented.

The C flow may be measured by means other than directly with a sensor. It may also be measured indirectly by determining the difference between the measured amount of carbon introduced into the furnace and the amount exhausted or not consumed. It is convenient in the process to determine the amount of carbon supplied from the volume of gas introduced during a certain period of time and its carbon content, the amount of carbon exhausted from the volume of flare gas and its carbon content and the amount of carbon not consumed from the proportion of soot remaining in the furnace. It has been found sufficient in actual practice to combine the amount of carbon exhausted and the unused portion remaining in the furnace in the form of soot into a furnace specific utilization factor and determining the C flow from the amount of carbon introduced, the surface of the workpiece and the utilization factor. All of these measured values and process parameters may be, as known in itself, entered into a computer unit, when then produces from this and from the data important for the calculation of the variation of the carbon content of the surface layer and stored in the computer, such as the geometry of the steel part, the C content of the core and the coefficient of diffusion, the instantaneous variation of the C content in the steel part and issues as a function of the latter, signals to control the supply of the carburizing gas. This method may be applied both when the C flow is measured directly by means of a sensor or, as described above, determined from the amount of carbon introduced and exhausted. An advantage obtained thereby is that the consideration of the values of the carbon transfer coefficient and to a great extent also of the alloy composition may be eliminated.

For the realization of the process with the direct measurement of the C flow, an apparatus is provided, which in a known manner comprises a carburizing furnace with at least one heated chamber, sensors to measure the chamber temperature, a feeder line for the carburizing agent in which a variable control valve is arranged, and a sensor extending into the chamber with at least one electric measuring resistor exposed to the furnace atmosphere, such as described for example in the journal Stahl und Eisen 80 (1960, No. 26, pages 1952 to 1954). According to the invention, however, it is provided that the measuring resistor is acting as a C flow sensor and is located in a sensor chamber to which a feeder line for a carburizing gas is attached, and that in the feeder line, a stop valve controllable as a function of the values determined, is arranged. This carburizing gas may simultaneously constitute the reference gas for the compensation reference resistor in installations with a sensor comprising a reference resistor exposed to the flow of a reference gas for temperature compensation. The feeder line containing the stop valve may then be branched off in a simple manner from the connecting line to the reference resistor. The stop valve receives its control pulses to open or close simply and intermittently from the computer unit, which thereby is adjusting the carbon content of the measuring resistor to the carbon content at the surface of the workpiece to be carburized. The variation in time of the C content of the measuring sensor thus corresponds to the progress of carburization on the surface of the workpiece.

Obviously, the carbon content of the sensor may be adjusted in a similar manner inversely to a decreasing carbon content of the atmosphere. The decarburizing phases are then replaced by carburizing phases.

For the realization of the second method set forth above, wherein the amounts of carbon introduced and exhausted are determined, advantageously an apparatus, again known in itself, comprising a carburizing furnace with at least one heated chamber, with coolers to determine the chamber temperature, with a feeder line for the carburizing agent wherein a variable control valve is located and with an exhaust line with a flare leading out of the chamber, is provided. According to the invention, in such an installation, the variable control valve in the carburizing gas feeder line is followed in line by a measuring element determining the flow volume and in the exhaust line a measuring instrument measuring the amount of C being exhausted, is provided. This configuration makes it possible, especially when certain furnace specific values are combined in a utilization factor, to have the computer unit evaluate the values determined by the measuring element and the measuring instrument, together with those of the temperature measurment, with values relating to the surface and the initial C content of the workpiece, together with data of the target values to be obtained and the utilzation factor, also being entered into the computer.

Naturally, it is possible to carry out with the new process and the new apparatus not only carburizing processes, but also for example, carbonitriding processes. In carborizing processes, in the final phase, it is feasible for the accurate adjustment of the C content of the case on the workpiece to switch to the known C potential control method. The advantage of the new process and apparatus consists of the higher availability of carbon in the initial phase, without the danger of overcarburizing.

BRIEF DESCRIPTION OF THE DRAWING

The objects and advantages of the invention will become apparent from the following detailed description of preferred embodiments thereof in connection with the accompanying drawings in which like numerals designate like elements, and in which.

DETAILED DESCRIPTION OF PREFERRED EMBODIMENTS OF THE INVENTION

Figure 1:
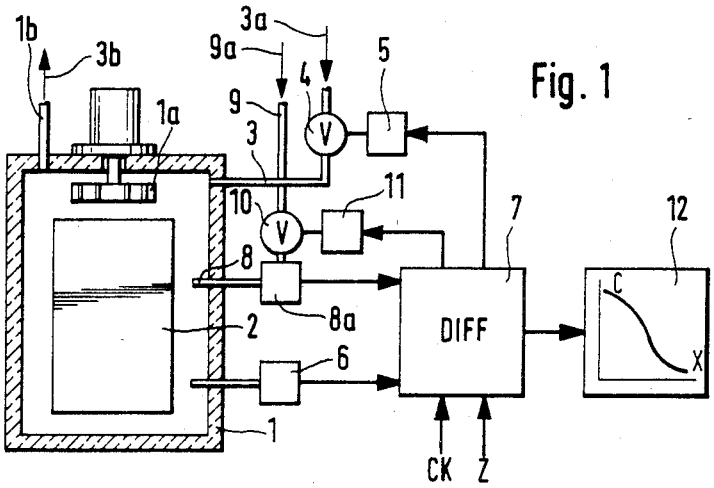
FIG. 1 is a schematic view of an installation according to the invention for the carburizing of steel, wherein a C flow sensor is used to control the carburizing process.

FIG. 1 shows a carburizing furnace 1 with a circulating installation shown in the form of a blower 1*a*, and containing a workpiece(s) 2 having a surface A to be carburized. A feeder line 3 for the carburizing agent opens into the furnace chamber, into which line 3 the carburizing gas is introduced in the direction of the arrow 3*a*. An exhaust line 1*b* leads from the carburizing furnace 1, with the exhaust gas 3*b* being flared-off. The furnace includes a conventional heat resistant insulating wall. A temperature sensor 6 is inserted in the furnace 1, the measured values of which are entered in a computer unit 7. A variable control valve 4, placed in the carburizing agent feeder line 3, may be actuated by means of a control element 5 which receives its control pulses from the computer 7.

A C-flow sensor 8 is inserted into the furnace 1, the sensor head 8*a* whereof is connected with the computer 7, so that the values determined by the C-flow sensor 8 may be evaluated by the computer 7. The sensor head 8 is connected to a feeder line 9 which conducts a decarburizing gas introduced in the direction of the arrow 9*a*. A stop valve 10 is set in the feeder line 9, which valve may be opened or closed by means of a control element 11 actuated by the computer 7. The target values Z and the value of the initial C content CK of the workpiece(s) 2 are also entered in the computer 7. The computer 7 is connected with a recorder 12 for the carbon variation C-X; it records the variation of carbon in the workpiece as a function of the distance from the surface. This variation is determined by the computer 7 in a known manner.

Figure 2:
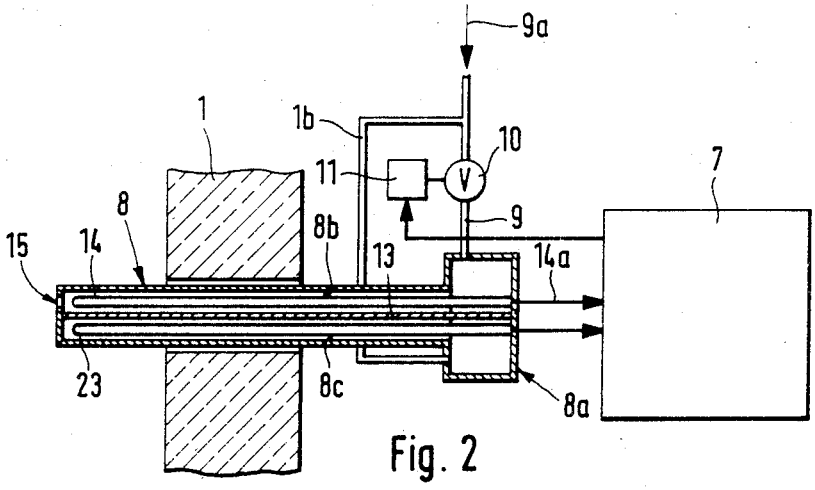
FIG. 2 is a schematic and enlarged view of the C flow sensor of FIG. 1.

It is apparent from FIG. 2 that the C-flow sensor 8 comprises a tube divided into two chambers 8*b* and 8*c* by a wall 13. Those chambers extend into the sensor head 8*a*. The chamber 8*b* contains a measuring resistor 14, which carries an electric current and is connected by means of a connecting line 14*a* with an evaluating circuit in the computer 7. The chamber 8*b* is further connected with the feeder line 9 for the decarburizing agent. An opening 15 in the wall of the chamber 8*b* communicates that chamber with the interior of the furnace 1 to expose the resistor 14 to the furnace atmosphere.

The chamber 8*a* of the C-flow sensor 8 is connected through a connecting line 16 with the feeder line for the decarburizing agent, so that the chamber 8*a* is constantly exposed to a certain volume of the decarburizing agent, which in the present example of embodiment also serves as the reference gas. A reference signal is thus supplied to the computer 7 by a measuring resistor 23 for temperature compensation.

EXAMPLE

The mode of operation of the apparatus of FIGS. 1 and 2 shall now be described with reference to an example.

In the carburizing furnace 1, for example, in the form of a retort furnace, a charge 2 of steel workpieces with an initial C content of 0.20% and a total surface area A of 10 $m^2$ is carburized at 930° C. The target values at the completion of the process are as follows:

Depth of carburization = 1 mm at 0.35% C;
Boundary layer C content CR = 0.80% C'
The C variation at the surface should be flat.

These target values yield a carbon requirement—calculated—of 35 $g/m^2$.

For reasons of economy, a short carburizing period, i.e., high carbon availability, is desired. However, the C content at the surface should not exceed 1.00% C during carburization, in order to prevent the formation of carbides. Prior to its discharge, the temperature of the charge 2 is to be reduced to the hardening temperature of 860° C.

In the course of the heating of the charge 2, the furnace 1 is flushed with nitrogen.

Beginning at 850° C. a small amount of methanol is added to form CO and $H_2$ and natural gas as the carburizing agent feeder line 3, in a proportion high enough so that it is not possible to effect a measurement of the C potential. In Stage I of the process indicated in FIG. 4, the C flow is limited to avoid excessive soot formation in the furnace 1. In Stage II, the C flow is reduced, as otherwise the surface C content would exeed 1%.

The atmosphere in the furnace 1 is monitored by the C flow sensor 8 with the measuring resistor 14, which may comprise, for example, an iron wire with a diameter of 0.2 mm, the C carbon content whereof varies by 0.26% C/h, when the C flow amounts to 1 $g/m^2h$, this being derived from the surface/volume ratio of the sensor 8.

Figure 3:
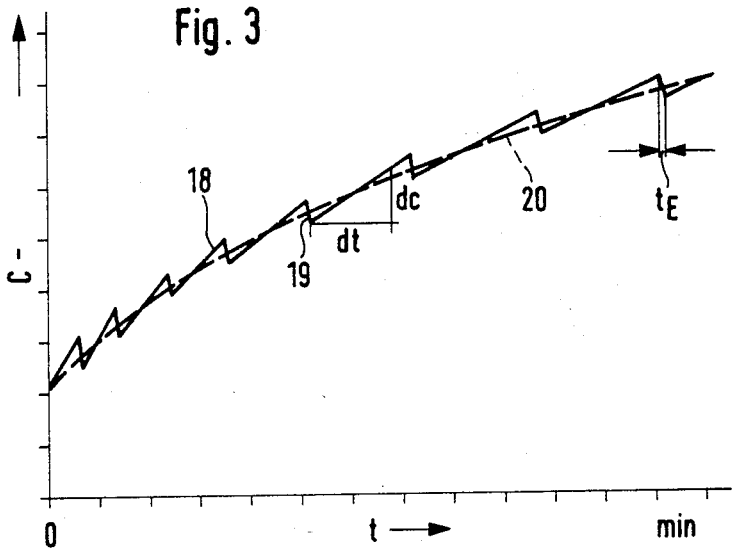
FIG. 3 is a diagram representing the variation of the C content of the sensor of FIG. 2 and its control as a function of time.

The carbon content C of the sensor is adjusted to the surface C content of the workpiece charge 2 by the decarburizing cycles actuated by the computer 7, as seen in FIG. 3. In FIG. 3, the C content of the sensor is indicated by a solid line. This saw tooth line is designated by 18. The decarburizing phases 19 are actuated by the computer 7. In this case the stop valve 10 (actuated by the computer) opens and for a short period of time the decarburizing agent flows through the chamber 8*b*.

The mean value of the variation of the C content on the sensor thus corresponds to the broken line 20, representing the variation of the surface C content on the workpiece 2 as determined by the computer.

It is further seen in FIG. 3 that the time $t_e$ for the decarburizing phases is very short. That time is sufficient, however, to readjust the mean value of the C content of the sensor 8 to the surface C content 20.

From the dC/dt value, the C flow proportional to it, is determined.

Figure 4:
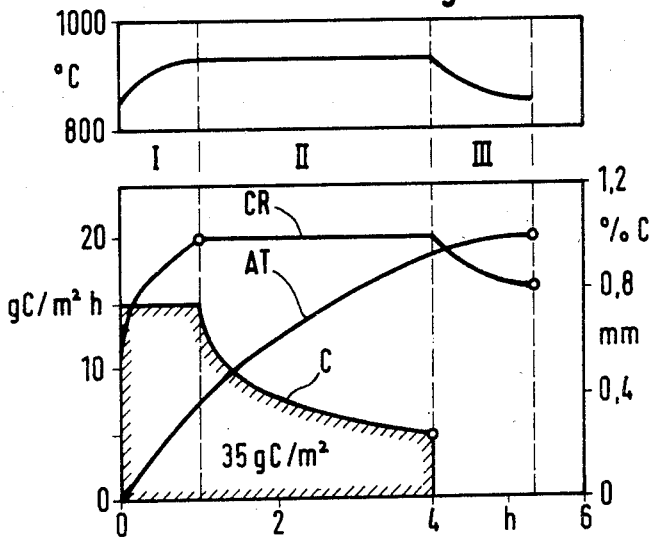
FIG. 4 shows diagrams of the variation of temperature, the boundary layer carbon content, the depth of carburization and the flow of C, each plotted with reference to the example described and over a time period.

The supply of the carburizing gas in the direction of the arrow 3*a* is interrupted as soon as the sum of the carbon introduced coincides with the predetermined target value of 35 $g/m^2$. In the example of embodiment according to FIG. 4, this is obtained after four hours. After this, diffusion is effected with the introduction of nitrogen, until the computer 7 indicates the predetermined surface C content, which after 5 h and 20 min is at 0.8% in FIG. 4, as desired (FIG. 4, Stage III). The temperature is reduced in the diffusion phase, as may be seen in the upper diagram of FIG. 4 representing the variation of temperature within the stages I, II, III.

Figure 5:
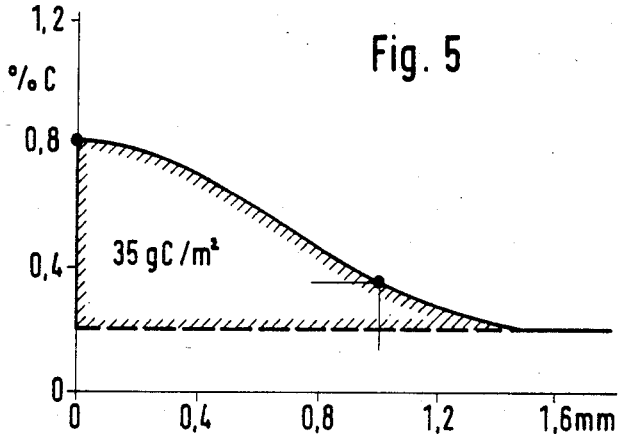
FIG. 5 is a diagramatic view of the variation of carbon at the end of the process as a function of the distance from the surface.

The charge print-out (FIG. 4) provided by the computer 7 illustrates the carburizing process controlled by means of the flow of C. FIG. 5 shows the final carbon variation at the end of the process; it coincides with the predetermined target values. In FIG. 5, the distance from the surface in the workpiece is plotted on the abcissa and on the ordinate the C content. The surface carbon content CR is 0.80% C. At the depth of carburization CR of 1 mm the C content is 0.35% C.

Figure 6:
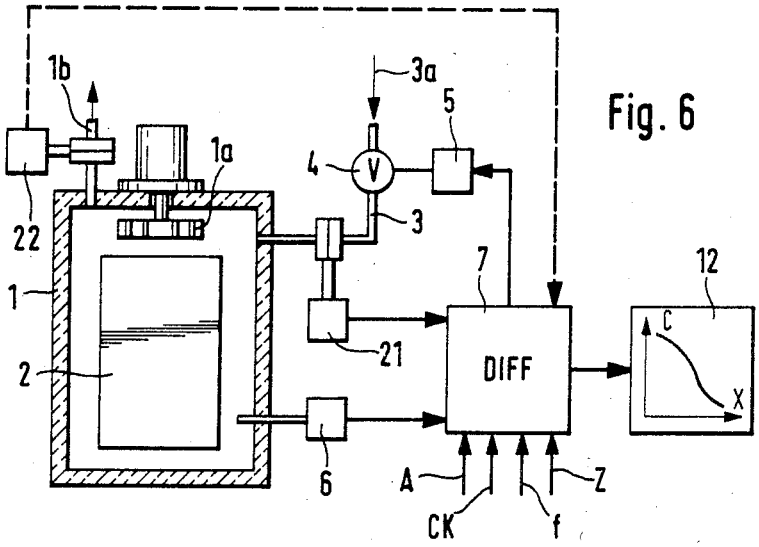
FIG. 6 is a schematic view of a further apparatus for the realization of the process according to the invention operating without a C flow sensor.

FIG. 6 depicts a further embodiment of the invention for controlling the carburizing process by means of the C flow. In that figure, like reference numbers are used to designate like parts from FIGS. 1 and 2. In a deviation from the apparatus of FIG. 1, the variable control valve 4 in the carburizing feeder line 3 is followed in line by a measuring element 21, measuring the volume flowing through. In the exhaust line 1*b*, a measuring instrument 22 is arranged to mesure the outflowing amount of C. In this apparatus the amount of carbon introduced (and its known carbon content) is determined from the amount of the carburizing gas fed in during a certain period of time. Also determined is the amount of carbon exhausted from the volume of flare gas exhausted during the same period of time through the line 1*b*. The unused amount of carbon thus comprises the proportion of soot remaining in the furnace. The difference in carbon obtained in this manner has passed into the workpiece charge 2, the area of the surface A of which is also known. In actual practice, the amount of carbon exhausted through the line 1*b* and the unused carbon in the form of soot in the furnace 1 is combined into a furnace specific utilization factor f and the C flow determined from the amount of carbon introduced as measured by the measuring element 21, the known surface A of the workpiece and the utilization factor f, so that a carbon flow m is obtained; $m=(f.K)/A$, wherein K is the amount of carbon introduced in $gC/m^2h$. These values are entered into the computer 7 in addition to the values for the initial surface carbon content CK of the workpiece and the target values Z. The computer then determines the flow of carbon in a manner similar to that of FIG. 4. The supply of the carburizing agent by the carburizing feeder line 4 through the valve 4 is controlled as a function of this determination.

The process and apparatus according to the present invention (FIGS. 1–6) may be utilized when so-called equilibrium atmospheres are present, for which the carbon potential may be defined and measured, and also when atmospheres supersaturated with hydrocarbons are present, the employment of which may lead to savings in raw material and energy.

Although the present invention has been described in connection with preferred embodiments thereof, it will be appreciated by those skilled in the art that additions, modifications, substitutions and deletions not specifically described, may be made without departing from the spirit and scope of the invention as defined in the appended claims.

What is claimed is:

1. Apparatus for the gas carburization of a steel part in which the surface of the steel part is exposed to a carbon-enriched atmosphere, said apparatus comprising:

a carburizing furnace having a heated chamber in which the steel part is to be positioned, temperature sensing means for sensing the temperature of the atmosphere in said furnace chamber, a first feeder line for introducing a carburizing agent into said furnace chamber, a first control valve in said first feeder line for controlling the rate of flow of said carburizing agent, carbon sensing means extending into said chamber and including an electric measuring resistor formed of iron and exposed to the furnace chamber to measure a carbon content of said atmosphere, said resistor disposed in a sensor chamber exposed to said furnace chamber, a second feeder line for introducing a decarburizing gas directly into said sensor chamber, a second control valve in said second feeder line for regulating the flow of decarburizing gas to said sensor chamber, analyzer means for receiving a temperature value from said temperature sensor and a carbon value from said carbon sensor for a time interval to calculate a flow of carbon diffusion into the surface of the steel part during such interval and for generating a control signal as a function thereof for actuating said first control valve to vary the flow of carburizing agent into said furnace chamber, and for periodically readjusting the carbon content of said measuring resistor to correspond to the carbon content of the surface of the steel part by intermittently actuating said second control valve to supply decarburizing gas to said sensor chamber, so that said measuring resistor attains substantially the same carbon content as said surface of the steel part to reduce the risk of overcarburizing that surface.

2. Apparatus according to claim 1 including a flow line branching off said second feeder line upstream of said second control valve, a reference sensor including a reference resistor extending into said furnace chamber for supplying a temperature compensation signal to said analyzer means, said flow line communicating with said reference resistor to expose the latter to the decarburizing gas.

* * * * *